US010549552B1

(12) United States Patent
Hoover et al.

(10) Patent No.: US 10,549,552 B1
(45) Date of Patent: Feb. 4, 2020

(54) METHOD AND APPARATUS FOR CREATING A WATERMARK VIA THERMAL GRADIENTS IN A DRYER

(71) Applicant: Xerox Corporation, Norwalk, CT (US)

(72) Inventors: Linn C. Hoover, Webster, NY (US); Chris Mieney, Rochester, NY (US); Paul Michael Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/228,604

(22) Filed: Dec. 20, 2018

(51) Int. Cl.
*B41M 7/00* (2006.01)
*B41J 11/00* (2006.01)
*B41M 5/00* (2006.01)

(52) U.S. Cl.
CPC ..... *B41J 11/002* (2013.01); *B41M 5/0011* (2013.01)

(58) Field of Classification Search
CPC .. B41M 7/0081; B41M 7/009; B41M 5/0011; B41J 11/002
See application file for complete search history.

(56) References Cited

U.S. PATENT DOCUMENTS 8,152,290 B2 * 4/2012 Daniel ..... B41F 19/02 347/102

* cited by examiner

*Primary Examiner* — Huan H Tran

(57) ABSTRACT

An apparatus and a method for creating a watermark are disclosed. For example, the apparatus may be a dryer module of a printing device. The dryer module may include a pair of transport rollers, a temperature gradient transport belt coupled to the pair of transport rollers to rotate around the pair of transport rollers, a heat source located above the temperature gradient transport belt, wherein the heat source applies heat to a print media that moves below the heat source via the temperature gradient transport belt, and a processor communicatively coupled to the rollers and the heat source, wherein the processor controls a speed of the temperature gradient transport belt via the pair of rollers and an amount of heat that is applied by the heat source to dry a printing fluid dispensed on selected portions of the print media at a desired rate to create the watermark on the print media.

20 Claims, 4 Drawing Sheets

METHOD AND APPARATUS FOR CREATING A WATERMARK VIA THERMAL GRADIENTS IN A DRYER

The present disclosure relates generally to processing print media and, more particularly, to a method and apparatus for creating a watermark via thermal gradients in a dryer.

BACKGROUND

A watermark is an identifying image or pattern in paper. The watermark may appear as various shades of lightness or darkness when viewed caused by variations in thickness or density variations of the paper. Watermarks can be used for security to discourage counterfeiting, for identification purposes, and the like. Watermarks can be used on postage stamps, currency, government documents, and the like.

Watermarks can currently be created using processes such as a dandy roll process or a cylinder mold process. The dandy roll process may impress a water-coated metal stamp onto the paper during manufacturing. The cylinder mold process may use tonal depth and creates a greyscale image. The watermark may be created by areas of relief on a roll's own surface.

SUMMARY

According to aspects illustrated herein, there are provided a dryer module of a printing device and a method for creating a watermark. One disclosed feature of the embodiments is a dryer module of a printing device that comprises a pair of transport rollers, a temperature gradient transport belt coupled to the pair of transport rollers to rotate around the pair of transport rollers, a heat source located above the temperature gradient transport belt, wherein the heat source applies heat to a print media that moves below the heat source via the temperature gradient transport belt, and a processor communicatively coupled to the rollers and the heat source, wherein the processor controls a speed of the temperature gradient transport belt via the pair of rollers and an amount of heat that is applied by the heat source to dry a printing fluid dispensed on selected portions of the print media at a desired rate to create the watermark on the print media.

Another disclosed feature of the embodiments is for creating a watermark that is executed by a processor. The method comprises installing a temperature gradient transport belt on a pair of transport rollers in a dryer of a printing device, dispensing a printing fluid on a print media, and transporting the print media on the temperature gradient transport belt through the dryer under a heat source to dry the printing fluid at a desired rate on selected portions of the print media to create the watermark.

Another disclosed feature of the embodiments is a non-transitory computer-readable medium having stored thereon a plurality of instructions, the plurality of instructions including instructions which, when executed by a processor, cause the processor to perform operations that dispensing a printing fluid on a print media and transporting the print media on a temperature gradient transport belt that installed on a pair of transport rollers through the dryer under a heat source to dry the printing fluid at a desired rate on selected portions of the print media to create the watermark.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a method and apparatus for creating a watermark via thermal gradients within the sheet of printed media while in a dryer. As discussed above, watermarks can be used for security to discourage counterfeiting, for identification purposes, and the like. Watermarks can be used on postage stamps, currency, government documents, and the like. Current processes to create watermarks may include a dandy roll process or a cylinder mold process.

Currently, printers can be used to perform a variety of different functions. For example, printers can be used to print, fax, scan, copy, and the like. Thus, printing devices have become multi-function devices. The present disclosure adds another possible function that can be performed by a printer. For example, certain printing devices can be used to create watermarks on print media.

In one embodiment, the dryer modules in a printer that prints on coated paper may be used to create the watermark. The dryer modules may use dryer belts that are used to transport the coated paper. The dryer belts may be designed with a desired shape, pattern, graphic, and the like, for a desired watermark that can be transferred on the coated media. The dryer belts may generate a thermal gradient to generate the watermark on the coated media.

In some embodiments, other parameters may also control how the watermark is printed onto the coated media. For example, an amount of heat energy and the amount of time that the heat is applied may be one parameter that affects the printing of the watermark. In one example, how the ink is dispensed at each location on the coated media may also affect the printing of the watermark. How these parameters can affect the printing of the watermark are discussed in further details herein.

Figure 1:
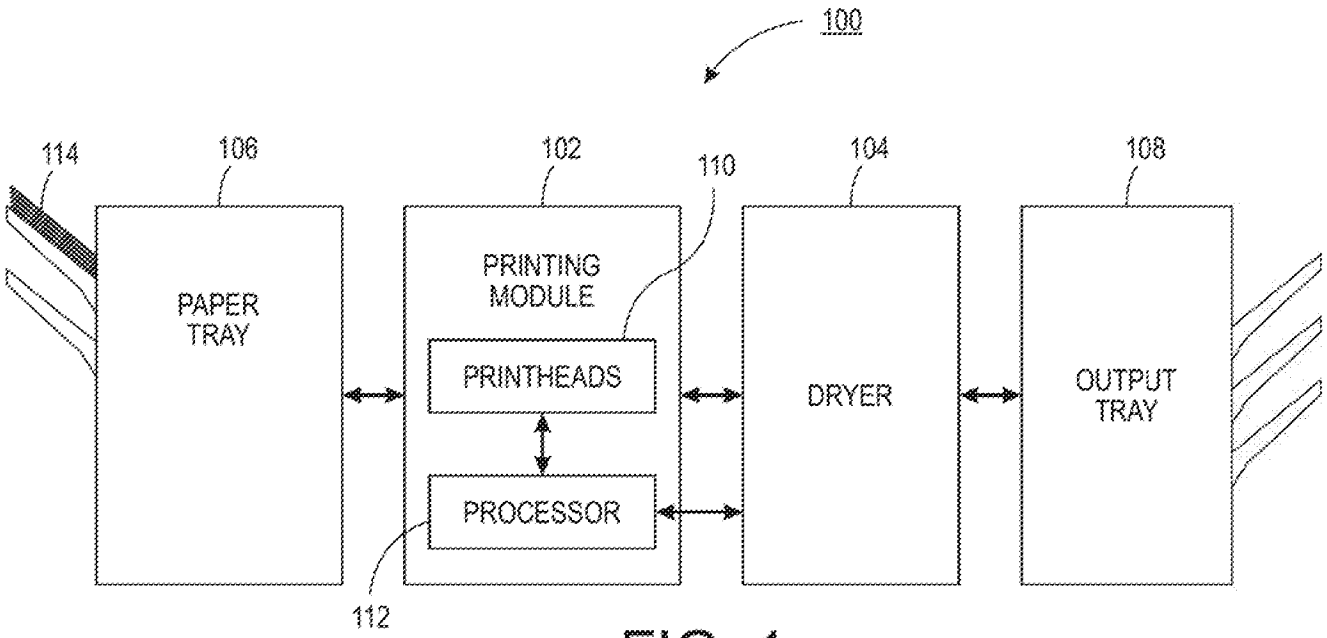
FIG. 1 illustrates an example printing device of the present disclosure.

FIG. 1 illustrates an example printing device 100 of the present disclosure. In one embodiment, the printing device 100 may include a printing module 102, a dryer 104, a paper tray 106, and an output tray 108. In one embodiment, the paper tray 106 may hold print media 114 that may be fed through the printing module 102, the dryer 104, and the output tray 108.

In one embodiment, the print media 114 may be a coated media. For example, the print media may be coated with calcium carbonate, bentonite, talc, clay, or other materials to improve the surface smoothness and reduce ink absorbency. The coating may give the media a matte, silk, or glossy appearance. A clay based coating may prevent ink from absorbing easily into the paper fibers of the print media.

In one embodiment, the printing module 102 may include printheads 110 and a processor 112. The printheads 110 may include a plurality of different printheads to dispense different colored printing fluid. In one embodiment, the printing fluid may be a high fusion ink that is used to print on coated print media. The high fusion ink consists of water and co-solvents that act as a carrier fluid for the color pigments or dyes. The high fusion ink may evaporate at temperatures below 150 degrees Celsius. For example, the solvents and water in the high fusion ink may completely evaporate out at temperatures above 100 degrees Celsius and below 150 degrees Celsius.

In one embodiment, the processor 112 may be communicatively coupled to the printheads 110 and the dryer 104. The processor 112 may control operation of the printheads 110 and components within the dryer 104, as discussed in further details below.

In one embodiment, the output tray 108 may store the print media 114 that have been processed. In one embodiment, the output tray 108 may include a finishing module that may perform operations such as collating, stapling, stacking, offsetting, and the like.

In one embodiment, the printing device 100 has been simplified for ease of explanation. The printing device 100 may include additional components that are not shown. For example, the printing device 100 may include a scanner module, a copy module, a digital front end to convert print jobs into a printer description language, various transport paths, and the like.

Figure 2:
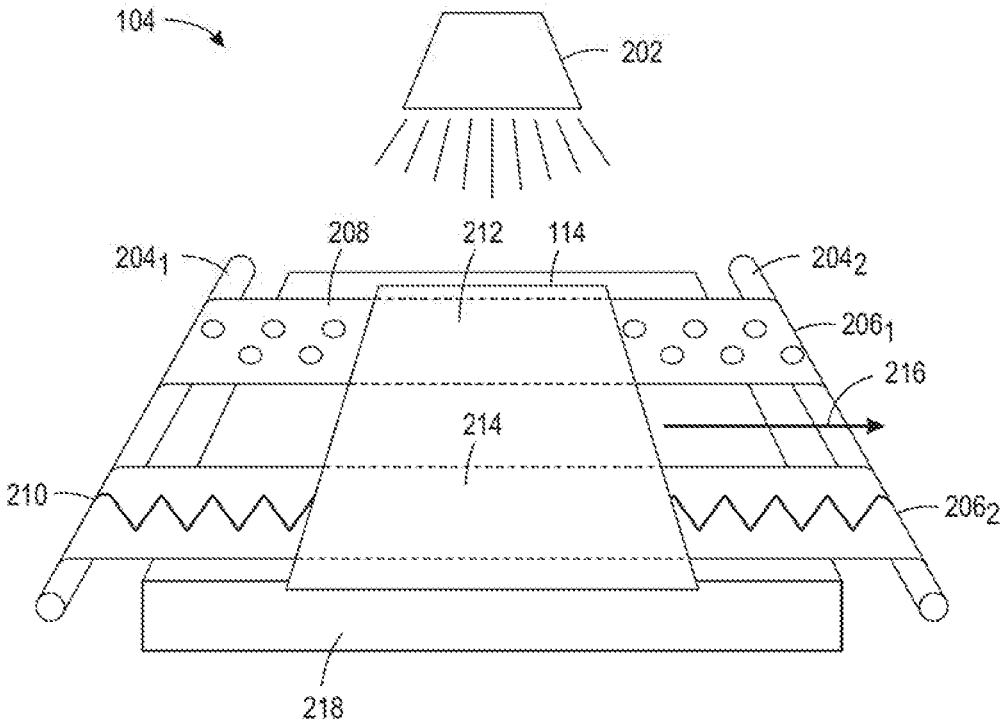
FIG. 2 illustrates an example dryer of the printing device and a belt in the dryer module that is used to create the watermark on the coated media of the present disclosure.

FIG. 2 illustrates an example of the dryer 104 of the printing device 100. In one embodiment, the dryer 104 may include a heat source 202 and a pair of transport rollers $\mathbf{204}_1$ and $\mathbf{204}_2$. In one embodiment, a transport belt (not shown) may be mounted on transport rollers $\mathbf{204}_1$ and $\mathbf{204}_2$. One of the transport rolls $\mathbf{204}_1$ and $\mathbf{204}_2$ may be driven by mechanical input through a set of gears or a belt. The transport belt may be coupled to the transport rollers $\mathbf{204}_1$ and $\mathbf{204}_2$ that are driven and rotated under the heat source 202.

In one embodiment, the heat source 202 may be any type of heat source that can apply energy to the print media 114 to dry printing fluid 212 and 214 dispensed on the print media 114. In one embodiment, the heat source 202 may be an infrared (IR) heat source that applies IR energy on the print media 114 to dry the printing fluid 212 and 214.

In one embodiment, although the printing fluid 212 and 214 are illustrated as being on certain portions of the print media 114, it should be noted that the printing fluid 212 and 214 may be dispensed anywhere on the print media 114. The printing fluid 212 and 214 may be printed on locations that correspond to locations of thermal gradient transport belts $\mathbf{206}_1$ and $\mathbf{206}_2$ and a desired location or locations of the watermark that is to be created.

In one embodiment, the transport rollers $\mathbf{204}_1$ and $\mathbf{204}_2$ may be spaced apart from one another on opposite ends of the dryer 104. In one embodiment, although only two transport rollers $\mathbf{204}_1$ and $\mathbf{204}_2$ are shown in FIG. 1, it should be noted that the dryer 104 may include additional pairs of transport rollers.

In one embodiment, the thermal gradient transport belt $\mathbf{206}_1$ and/or $\mathbf{206}_2$ may be coupled to the transport rollers $\mathbf{204}_1$ and $\mathbf{204}_2$. In another embodiment, the thermal gradient transport belt $\mathbf{206}_1$ and/or $\mathbf{206}_2$ may be wrapped around the transport belt, as noted above, and can be attached and removed easily to change water marks between print jobs. Although two thermal gradient transport belts $\mathbf{206}_1$ and $\mathbf{206}_2$ are illustrated in FIG. 2, it should be noted that a single thermal gradient transport belt or more than two thermal gradient transport belts may be installed or deployed on the transport rollers $\mathbf{204}_1$ and $\mathbf{204}_2$ and/or a transport belt.

In one embodiment, the dryer 104 may include a vacuum plenum 218. The vacuum plenum 218 may provide a vacuum to hold the print media 114 against the transport rollers $\mathbf{204}_1$ and $\mathbf{204}_2$ and/or the transport belt, discussed above.

In one embodiment, the thermal gradient transport belts $\mathbf{206}_1$ and $\mathbf{206}_2$ may be fabricated from a silicone material. In another embodiment, the thermal gradient transport belts $\mathbf{206}_1$ and $\mathbf{206}_2$ may be fabricated from a fabric.

In one embodiment, the thermal gradients in the thermal gradient transport belts $\mathbf{206}_1$ and $\mathbf{206}_2$ may be created in any way that may change the way a portion, or different portions, of the thermal gradient transport belts $\mathbf{206}_1$ and $\mathbf{206}_2$ absorb energy or heat. The watermarks may be created in the print media 114 by the thermal gradients. For example, portions of the thermal gradient transport belts $\mathbf{206}_1$ and $\mathbf{206}_2$ that absorb energy at a faster rate may cause the water and solvents in the printing fluid 212 and 214 to evaporate more quickly. The difference in drying in different areas of the printing fluid 212 and 214 may cause a difference in the distribution of the pigment suspended in the carrier fluid, thus, creating the watermarks.

In one embodiment, the thermal gradients may be made by a cutout 208 in the thermal gradient transport belt $\mathbf{206}_1$. For example, areas in the thermal gradient transport belt $\mathbf{206}_1$ that have the cutout 208 may not contact the print media 114. The portions of the print media 114 over the cutout areas may not receive heat from the hot thermal gradient transport belt $\mathbf{206}_1$ and may be cooler in the portions that are over areas with the cutout 208. The printing fluid 212 and 214 on the print media 114 surrounding the area of the cutout 208 may dry faster causing the color pigment to coalesce around the border of the cutout 208 creating a dark outline of a shape associated with the cutout 208. In one embodiment, the cutout 208 may have a design that is used to create the watermark. In other words, the design of the cutout 208 may be the same as the design of the watermark that is created. In one embodiment, the design may be a pattern, an image, alpha-numeric text, or any combination thereof.

In one embodiment, the thermal gradients may be made by an embroidered design 210 in the thermal gradient transport belt $\mathbf{206}_2$. As noted above, some thermal gradient transport belts may be fabricated from a fabric. The thermal gradient transport belt $\mathbf{206}_2$ may be a fabric with an embroidered design 210. For example, the embroidered design 210 may be embroidered with a dark fabric that absorbs energy faster than the rest of the thermal gradient transport belt $\mathbf{206}_2$. As a result, the print media 114 contacting the hot dark fabric may be hotter than the surrounding area causing the carrier fluid to dry faster and coalescing the pigment in the shape of the embroidered design 210 to create a watermark in the print media 114. The embroidered design 210 may be a pattern, an image, alpha-numeric text, or any combination thereof.

In one embodiment, the speed of the transport rollers $\mathbf{204}_1$ and $\mathbf{204}_2$ may be controlled. The speed of the transport rollers $\mathbf{204}_1$ and $\mathbf{204}_2$ may determine a speed that the print media 114 moves under the heat source 202 as shown by an arrow 216. In one embodiment, how much heat is applied by the heat source 202 and an amount of time that the print media 114 spends under the heat source 202 may determine a visibility of the watermarks. For example, higher heat and longer times under the heat source 202 may create more visible watermarks. Lower heat and/or lower times under the heat source 202 may create less visible watermarks.

In some examples, different belt materials may have different levels of thermal gradients. For example, a thick silicone belt may have a higher thermal conductivity compared to a fabric belt. The silicone belt may absorb more heat from the heat source 202. Thus, a silicone belt may absorb more heat from the heat source 202 and generate the same amount of visibility of the watermark at a lower temperature setting for the heat source 202 of the faster transport belt speed as compared to a fabric belt.

In another embodiment, the visibility of the watermark may be controlled by controlling a drying rate of the printing fluid 212 and 214. In one embodiment, various parameters such as properties of the printing fluid 212 and 214 may affect the drying rate, and, therefore the amount of visibility of the watermark.

For example, an emissivity of the printing fluid 212 and 214 may also determine a visibility of the watermark. For example, some colors of inks may be denser than other colors of ink. The density may be measured in picoliters per square centimeter. The more dense the ink, the more emissivity the ink may possess. Thus, inks with a lower emissivity may be dispensed in larger amounts to create a watermark with the same visibility as using inks with a higher emissivity in a smaller amount.

In one embodiment, the parameters of the thermal gradient transport belts $\mathbf{206}_1$ and $\mathbf{206}_2$ may also affect the drying rate and amount of visibility of the watermark. As noted above, the thermal gradients of the thermal gradient transport belts $\mathbf{206}_1$ and $\mathbf{206}_2$ may affect the creation of the watermark. As noted above, the thermal gradients may depend on a material of the thermal gradient transport belts $\mathbf{206}_1$ and $\mathbf{206}_2$, a size of the cutout 208, a color of the embroidered pattern 210, and the like.

Figure 3:
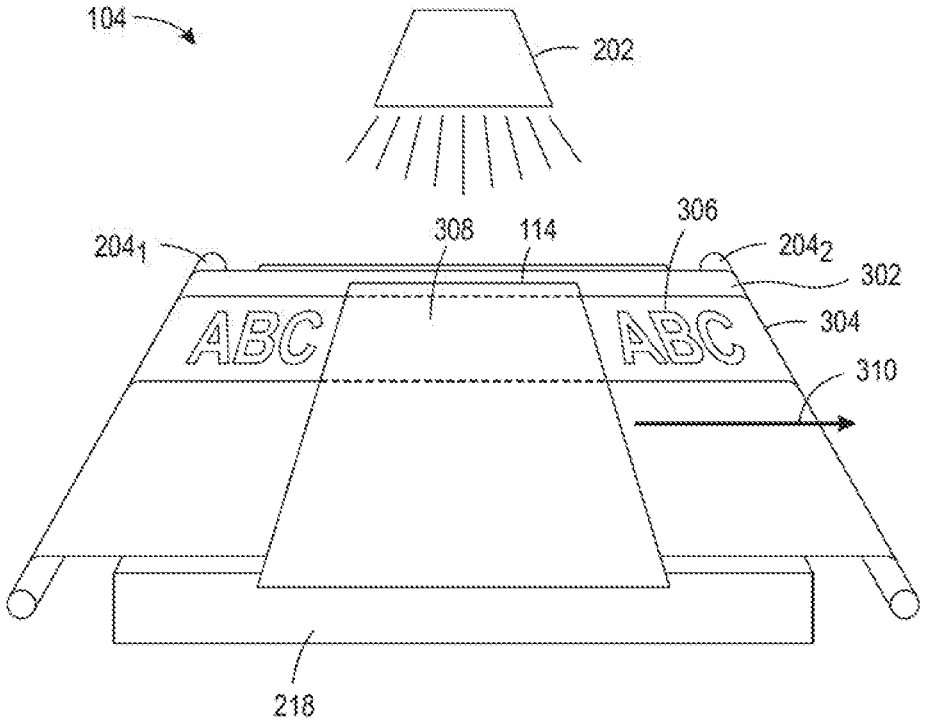
FIG. 3 illustrates another example of a belt in the dryer module that is used to create a watermark on the coated media of the present disclosure.

FIG. 3 illustrates another example of the dryer 104 of the printing device 100. In one embodiment, the dryer 104 in FIG. 3 may have the same transport rollers $\mathbf{204}_1$ and $\mathbf{204}_2$, heat source 202, and vacuum plenum 218. However, the dryer 104 may use a non-thermal gradient transport belt 302 to transport the print media 114.

In one embodiment, the non-thermal gradient transport belt 302 may be a fabric material with very small pores that are large enough to allow a vacuum to pass through the non-thermal gradient transport belt 302. The vacuum may hold the print media 114 against the non-thermal gradient transport belt 302. However, the sizes of the pores are small enough to prevent thermal gradients from forming. In some embodiments, the non-thermal gradient transport belt 302 may have components incorporated into the belt to create a thermal gradient.

In one embodiment, a thermal gradient transport belt 304 may be applied, or wrapped around, the non-thermal gradient transport belt 302. The thermal gradient transport belt 304 may be positioned anywhere along the non-thermal gradient transport belt 302 that corresponds to a desired location of the watermark on the print media 114. For example, the location of the thermal gradient transport belt 304 may correspond to an area in which a printing fluid 308 is dispensed on the print media 114 to create, or print, a watermark.

The thermal gradient transport belt 304 may be fabricated from the same types of materials as the thermal gradient transport belt $\mathbf{206}_1$ and $\mathbf{206}_2$, illustrated in FIG. 2 and described above. The thermal gradient transport belt 304 may also have a design 306. The design 306 may be cutout or embroidered as described above. For example, the design 306 is shown as being alpha-numeric text. However, as noted above, the design 306 may be a pattern, an image, the alpha-numeric text, or any combination thereof.

The watermark may be created on the print media 114 by moving the print media below the heat source 202 by the non-thermal gradient transport belt 302 and the thermal gradient transport belt 304 in a direction as shown by an arrow 310. Various parameters may control a drying rate to determine the amount of visibility of the watermark, as described above. For example, parameters such as an emissivity of the printing fluid, an amount of the printing fluid dispensed on a location of the print media, an amount of heat applied by the heat source, an amount of time the heat is applied by the heat source, or properties of the temperature gradient transport belt, may control the drying rate.

Figure 4:
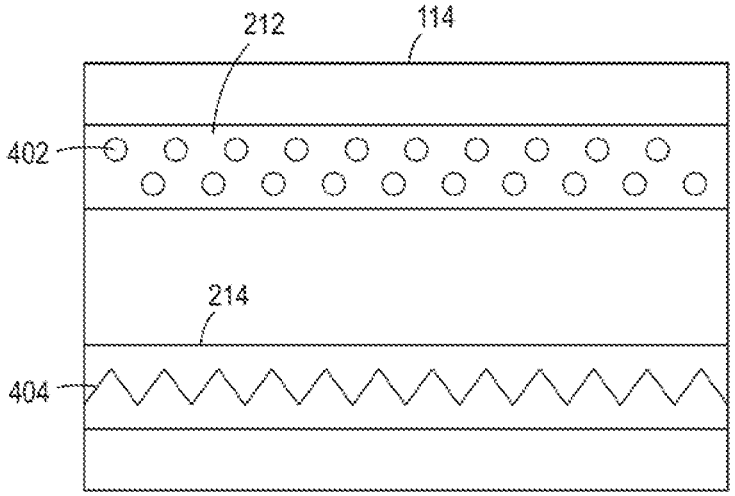
FIG. 4 illustrates an example of the watermark that is created on the coated media of the present disclosure.

FIG. 4 illustrates an example of watermarks 402 and 404 that may be created on the print media 114. For example, the watermarks 402 may be created in the printing fluid 212 by the thermal gradient transport belt $\mathbf{206}_1$ illustrated in FIG. 2, and discussed above. The watermarks 404 may be created in the printing fluid 214 by the thermal gradient transport belt $\mathbf{206}_2$. The watermarks 402 and 404 are shown in FIG. 4 as being clearly visible. However, as noted above, the visibility of the watermarks 402 and 404 may be subtle, or barely visible to the naked eye. The amount of visibility of the watermarks 402 and 404 may be a function of various parameters that control a drying rate in certain areas of the printing fluid 212 and 214, as described above.

Although printing fluid 212 and 214 is shown as only being dispensed on areas of the print media 114 where the watermarks 402 and 404 are created, it should be noted that the printing fluid may be dispensed anywhere on the print media 114. For example, the entire area of the print media 114 may receive printing fluid to print an image. However, the watermarks 402 and 404 may be created over the image in the printing fluid that is dispensed to print the image.

Thus, the printing device 100 may have a dryer 104 that can be used to create or print a watermark. Thus, the printing device 100 may be modified or improved to perform an additional function in addition to printing, scanning, copying, faxing, and the like. The watermark may provide an added security or identification to completed print jobs on the print media 114.

Figure 5:
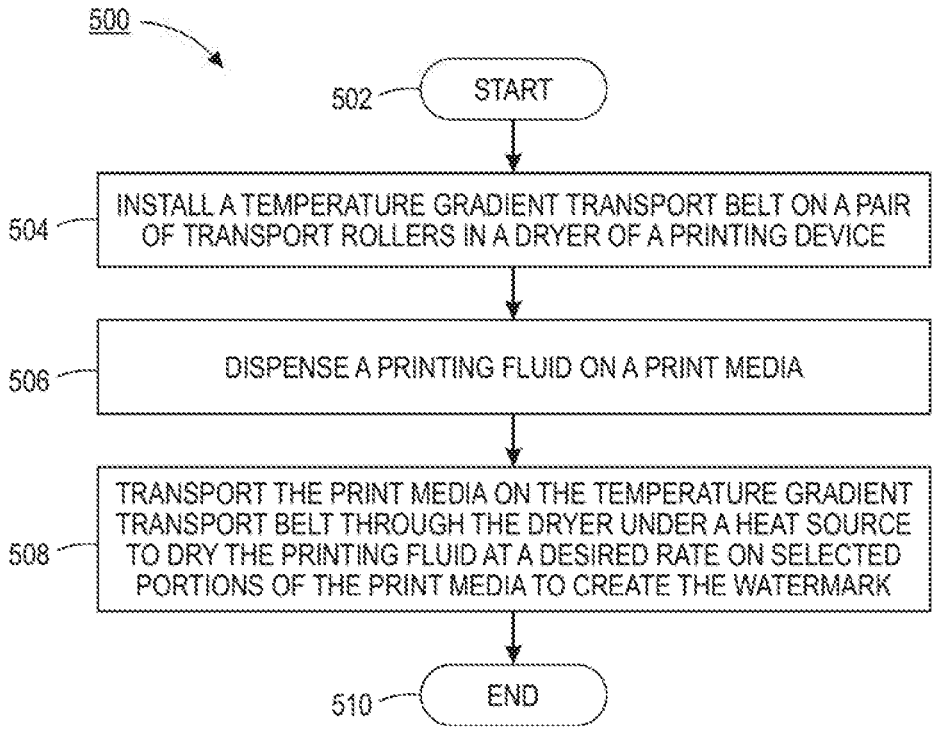
FIG. 5 illustrates a flowchart of an example method for creating a watermark via thermal gradients in a dryer of the present disclosure.
Figure 6:
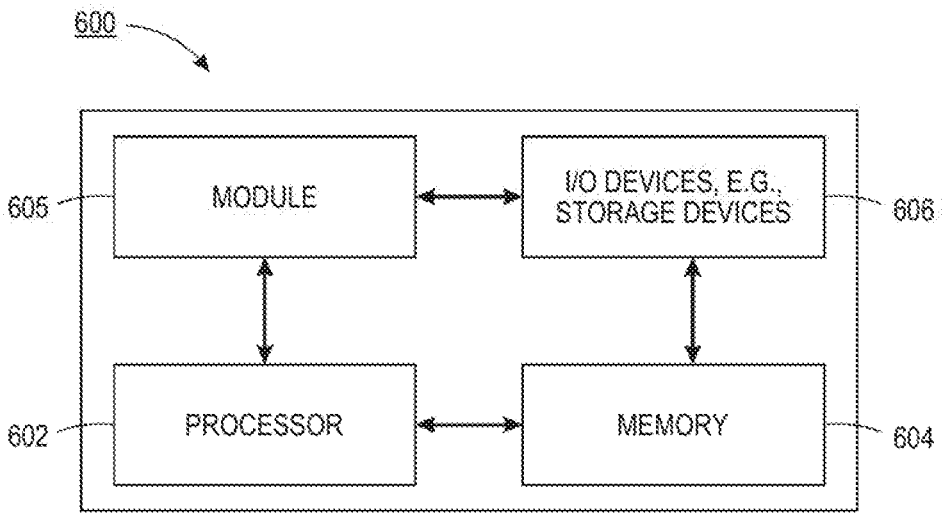
FIG. 6 illustrates a high-level block diagram of a computer suitable for use in performing the functions described herein.

FIG. 5 illustrates a flowchart of an example method 500 for creating a watermark via thermal gradients in a dryer of the present disclosure. In one embodiment, one or more steps or operations of the method 500 may be performed by the printing device 100, the dryer 104 of the printing device 100, or a computer as illustrated in FIG. 6 and discussed below.

At block 502, the method 500 begins. At block 504, the method 500 installs a temperature gradient transport belt on a pair of transport rollers in a dryer of a printing device. In one embodiment, the temperature gradient transport belt may include a design associated with a desired watermark to be printed on the print media. The design may be a pattern, an image, alphanumeric-text, and the like.

In one embodiment, the temperature gradient transport belt may be fabricated from a silicon material or a cloth material. The design may be cut out of the temperature gradient transport belt (e.g., in a silicone belt) or may be embroidered into the temperature gradient transport belt (e.g., in a cloth material belt). In other words, the design may be created in the temperature gradient transport belt in any method that may change the way the desired watermark receives and absorbs heat relative to the other portions of the temperature gradient transport belt.

In one embodiment, the temperature gradient transport belt may be positioned at a location that is associated with a desired location of the watermark on the print media. For example, the temperature gradient transport belt may be moved up and down the pair of transport rollers in the dryer to any desired position.

In one embodiment, the temperature gradient transport belt may be positioned or wrapped around a non-temperature gradient transport belt. The non-temperature gradient transport belt may be a cloth material based belt with very small pores. The pores may allow airflow through the belt to hold the print media, while not creating a temperature gradient on the belt. As a result, portions of the print media on the non-temperature gradient transport belt may avoid the creation of watermarks.

At block 506, the method 500 dispenses a printing fluid on a print media. In one embodiment, the print media may be a coated print media. For example, the print media may have a shiny or glossy appearance. The coated print media may be coated with a clay based coating. As result, the coated print media may prevent ink from absorbing easily into the paper fibers of the print media.

In one embodiment, the ink may be a high fusion ink. The high fusion ink may be a type of ink that is formulated to print and dry on coated print media.

At block 508, the method 500 transports the print media on the temperature gradient transport belt through the dryer under a heat source to dry the printing fluid at a desired rate on selected portions of the print media to create the watermark. For example, the watermark may be created based on a variety of parameters that affect how quickly the printing fluid may dry on the selected portions of the print media. In addition, the parameters may be adjusted based on an amount of visibility of the watermark that is desired by a user or for a particular application.

In one embodiment, the parameters may include an emissivity of the printing fluid, an amount of the printing fluid dispensed on a location of the print media, an amount of heat applied by the heat source, an amount of time the heat is applied by the heat source, properties of the temperature gradient transport belt, and the like. The emissivity of the printing fluid may vary based on the absorption rate of the color pigment relative to the applied heat energy. An example is the black colorant in black ink absorbs more IR wavelengths compared to Cyan or Yellow. Black ink heats faster and reaches higher temperatures under an IR heat source 202 which evaporates the carrier fluid faster compared to Cyan, Yellow and Magenta. The more dense a printing fluid that is applied to the print media, the greater the concentration of color pigment within a given area. As the carrier fluids dry over the temperature gradient features, the higher concentration of pigments may lead to more visible watermarks.

In one embodiment, the less dense the printing fluid, the lower the volume of carrier fluid and concentration of color pigment. As a result, there may be less carrier fluid to coalesce and less pigment to concentrate around the temperature gradient features, which may lead to less visible watermarks.

In one embodiment, the greater the amount of heat that is applied or the longer the printing fluid is exposed to the heat, the larger the temperature gradients. As a result, the watermark may be more visible. In addition, the larger the openings of the design, or the more the design is able to absorb heat, the larger the temperature gradients that may be created. As a result the watermark may be more visible. At block 510, the method 500 ends.

It should be noted that although not explicitly specified, one or more steps, functions, or operations of the method 500 described above may include a storing, displaying and/or outputting step as required for a particular application. In other words, any data, records, fields, and/or intermediate results discussed in the methods can be stored, displayed, and/or outputted to another device as required for a particular application.

FIG. 6 depicts a high-level block diagram of a computer that is dedicated to perform the functions described herein. As depicted in FIG. 6, the computer 600 comprises one or more hardware processor elements 602 (e.g., a central processing unit (CPU), a microprocessor, or a multi-core processor), a memory 604, e.g., random access memory (RAM) and/or read only memory (ROM), a module 605 for creating a watermark via thermal gradients in a dryer, and various input/output devices 606 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 605 for creating a watermark via thermal gradients in a dryer (e.g., a software program comprising computer-executable instructions) can be loaded into memory 604 and executed by hardware processor element 602 to implement the steps, functions or operations as discussed above in connection with the example method 500. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 605 for creating a watermark via thermal gradients in a dryer (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A dryer module of a printing device for creating a watermark, comprising:

a pair of transport rollers;

a temperature gradient transport belt coupled to the pair of transport rollers to rotate around the pair of transport rollers;

a heat source located above the temperature gradient transport belt, wherein the heat source applies heat to a print media that moves below the heat source via the temperature gradient transport belt; and a processor communicatively coupled to the rollers and the heat source, wherein the processor controls a speed of the temperature gradient transport belt via the pair of rollers and an amount of heat that is applied by the heat source to dry a printing fluid dispensed on selected portions of the print media at a desired rate to create the watermark on the print media.

2. The dryer module of claim 1, wherein the print media comprises a coated print media.

3. The dryer module of claim 1, wherein the temperature gradient transport belt comprises a design in the temperature gradient transport belt to create a temperature gradient.

4. The dryer module of claim 3, wherein the design comprises a pattern.

5. The dryer module of claim 3, wherein the design comprises an image.

6. The dryer module of claim 3, wherein the design comprises alpha-numeric text.

7. The dryer module of claim 1, further comprising:

a non-temperature gradient transport belt coupled to the pair of rollers, wherein the temperature gradient transport belt is wrapped around a portion of the non-temperature gradient transport belt.

8. The dryer module of claim 1, wherein the heat source comprises an infrared (IR) heat source.

9. The dryer module of claim 1, wherein the printing fluid comprises a high fusion ink.

10. The dryer module of claim 1, wherein the desire rate of drying the printing fluid is based on at least one of: an emissivity of the printing fluid, an amount of the printing fluid dispensed on a location of the print media, an amount of heat applied by the heat source, an amount of time the heat is applied by the heat source, or properties of the temperature gradient transport belt.

11. A method to create a watermark, comprising:

installing a temperature gradient transport belt on a pair of transport rollers in a dryer of a printing device;

dispensing, by the processor, a printing fluid on a print media; and transporting, by the processor, the print media on the temperature gradient transport belt through the dryer under a heat source to dry the printing fluid at a desired rate on selected portions of the print media to create the watermark.

12. The method of claim 11, wherein the print media comprises a coated print media.

13. A method of claim 11, wherein the selected portions are determined based on a design in the temperature gradient transport belt to create a temperature gradient.

14. The method of claim 13, wherein the design comprises a pattern.

15. The method of claim 13, wherein the design comprises an image.

16. The method of claim 13, wherein the design comprises alpha-numeric text.

17. The method of claim 13, wherein the temperature gradient transport belt is installed at a location on the pair of transport rollers based on a desired location of the watermark on the print media.

18. The method of claim 11, wherein the printing fluid comprises a high fusion ink.

19. The method of claim 11, wherein the desired rate of drying the printing fluid is based on at least one of: an emissivity of the printing fluid, an amount of the printing fluid dispensed on a location of the print media, an amount of heat applied by the heat source, an amount of time the heat is applied by the heat source, or properties of the temperature gradient transport belt.

20. A printing device having a dryer module for creating a watermark, comprising:

a printing module comprising a plurality of printheads to dispense a high fusion ink at desired locations on a coated print media to create the watermark at the desired locations at a desired amount of visibility, wherein an amount of the high fusion ink that is dispensed is based on an emissivity of a color of the high fusion that is dispensed;

a dryer module coupled to the printing module, wherein the dryer module comprises:

a pair of transport rollers;

a temperature gradient transport belt comprising a watermark design, wherein the temperature gradient transport belt produces non-uniform temperature gradients on a surface of the temperature gradient transport belt when heated as the temperature gradient transport belt is rotated around the pair of transport rollers; and an infrared (IR) heat source located above the temperature gradient transport belt, wherein the IR source applies IR energy to the coated print media that moves below the heat source via the temperature gradient transport belt to dry the high fusion ink at a desired rate; and a processor communicatively coupled to the printing module and the dryer module, wherein the processor controls the plurality of printheads, a speed of the temperature gradient transport belt via the pair of rollers, and an amount of heat that is applied by the heat source to dry a printing fluid dispensed on selected portions of the print media at the desired rate to create the watermark of the watermark design of the temperature gradient transport belt on the coated print media.

* * * * *